United States Patent [19]

Holden et al.

[11] Patent Number: 4,505,684

[45] Date of Patent: Mar. 19, 1985

[54] THRUST TUBE PROPULSION SYSTEM

[76] Inventors: Joseph T. Holden; Finn Christensen, both of 1300 Augusta Ste. 25, Houston, Tex. 77057

[21] Appl. No.: 446,180

[22] Filed: Dec. 2, 1982

[51] Int. Cl.[3] ..... B63H 11/02

[52] U.S. Cl. ..... 440/38; 440/68

[58] Field of Search ..... 114/78, 151; 440/38, 440/66, 67, 68, 69; 60/221, 222

[56] References Cited

U.S. PATENT DOCUMENTS

| | | | |
|---|---|---|---|
| 2,477 | 3/1842 | Bates et al. | 440/38 |
| 297,279 | 4/1884 | McDonald | 440/38 |
| 2,218,688 | 10/1940 | Stewart | 114/78 |
| 3,464,357 | 9/1969 | Duport | 114/151 |

FOREIGN PATENT DOCUMENTS

| | | | |
|---|---|---|---|
| 3042210 | 5/1982 | Fed. Rep. of Germany | 114/151 |
| 1419546 | 12/1975 | United Kingdom | 114/151 |

*Primary Examiner*—Trygve M. Blix
*Assistant Examiner*—Stephen P. Avila
*Attorney, Agent, or Firm*—Gunn, Lee & Jackson

[57] ABSTRACT

A thrust tube propulsion system for cargo vessels is disclosed. The propulsion system is incorporated beneath typical cargo vessel hulls by placing in the hull power equipment and by placing below the hull a plurality of longitudinally extending thrust tubes integrally affixed to the hull. Propellers are located within the thrust tubes at approximately the midpoint thereof to propel the vessel.

5 Claims, 7 Drawing Figures

THRUST TUBE PROPULSION SYSTEM

BACKGROUND OF THE INVENTION

This invention is directed to propulsion systems for many types of vessels including cargo vessels, particularly, comprising a thrust tube propulsion system incorporating partially enclosed propellers.

Propulsion systems for hulled cargo vessels are well known in the prior art and generally employ externally located propellors. The hull of conventional cargo hull is designed to direct water flow around the bow along the vessel amidships and past the stern of the vessel. The underwater section of the hull is streamlined to reduce resistance of the vessel hull on movement through the water. Thrust is created by propellers normally located at the stern of the vessel. Additionally, some vessels are provided with externally located steering gear such as bow and stern thrusters, rudders, keels, bilge keels, skegs and kort nozzels. Consequently, conventional vessels, particularly large vessels, are not easily maneuverable in shallow water and require water draft of ten feet or so to avoid damaging the externally located steering gear. This problem is even more severe with large, flat bottom scows. The thrust tube propulsion system of the present invention overcomes the disadvantages of the prior art vessels by eliminating the external steering gear and thus providing a vessel which is maneuverable in shallow water.

It is therefore an object of this invention to provide a thrust propulsion system for a vessel which eliminates the need for externally located steering gear. One feature of this invention to provide a vessel which is manueverable in shallow water, even as little as twenty inches of water.

A resultant advantage of this invention to provide a vessel which reduces the water resistance occurring at the bow. The bow wave is markedly reduced. This is accomplished by a feature of the invention whereby water is drawn through longitudinally extending thrust tubes incorporated in the hull of the vessel, which tubes open at or near the bow to induct water flow, thereby reducing the water pushed to the side by the bow. Because the cargo vessel has a smaller bow wave, it is more economical to operate than conventional vessels.

SUMMARY OF THE INVENTION

These and other objects, features and advantages of the invention are accomplished by the thrust tube propulsion system disclosed herein. The propulsion system incorporates a plurality of longitudinally extending tubes incorporated in the hull of the vessel. A propeller operatively connected to an engine via a drive shaft is located in each tube providing the thrust for moving the vessel. Each tube incorporates a reverse split venturi for increasing the velocity of water flowing therethrough. Manueverability of the vessel is accomplished by controlling the speed of the propeller and thus the thrust output thereof via a control panel.

BRIEF DESCRIPTION OF THE DRAWINGS

So that the manner in which the above recited features, advantages and objects of the present invention are attatined and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
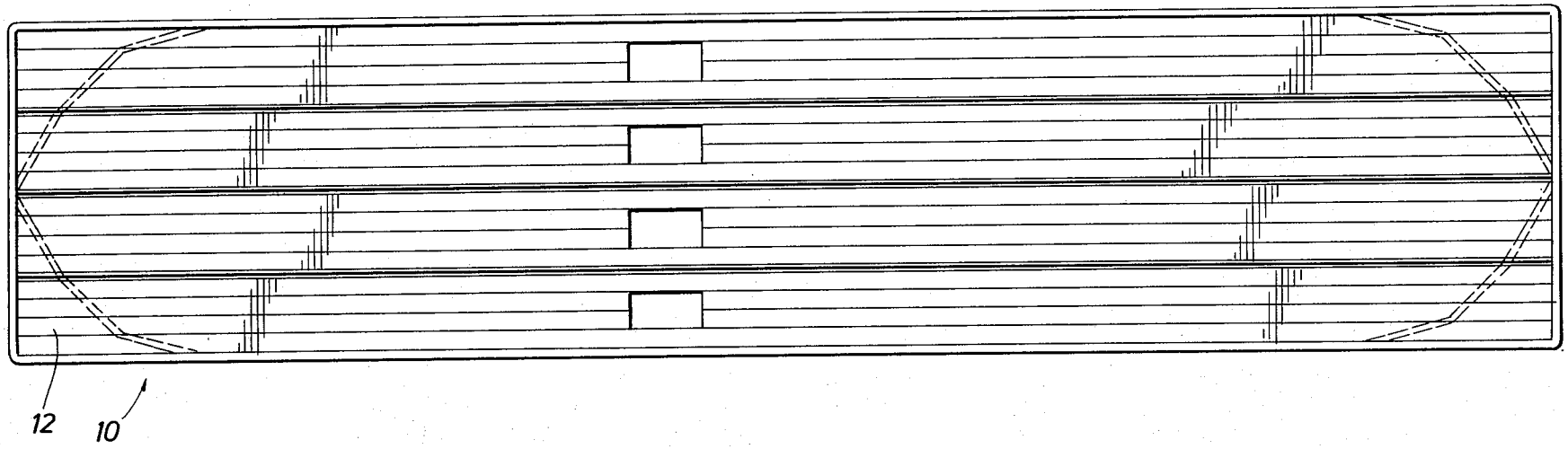
FIG. 1 is a top plan view of a vessel incorporating the thrust tube propulsion system of the invention.

Turning first to FIG. 1, a vessel incorporating the thrust tube propulsion system of the invention is shown. The vessel is generally identified by the reference numeral 10. The vessel 10 includes a deck 12 which may take a variety of shapes and sizes. For illustrative purposes only, a rectangular platform type deck 12 is shown in FIG. 1. The deck 12 is supported on a plurality of bulkheads 14 in a manner which is well known in the prior art. However, the interior and the hull of the vessel 10 have been designed to incorporate the thrust tube propulsion system of the invention.

Figure 2:
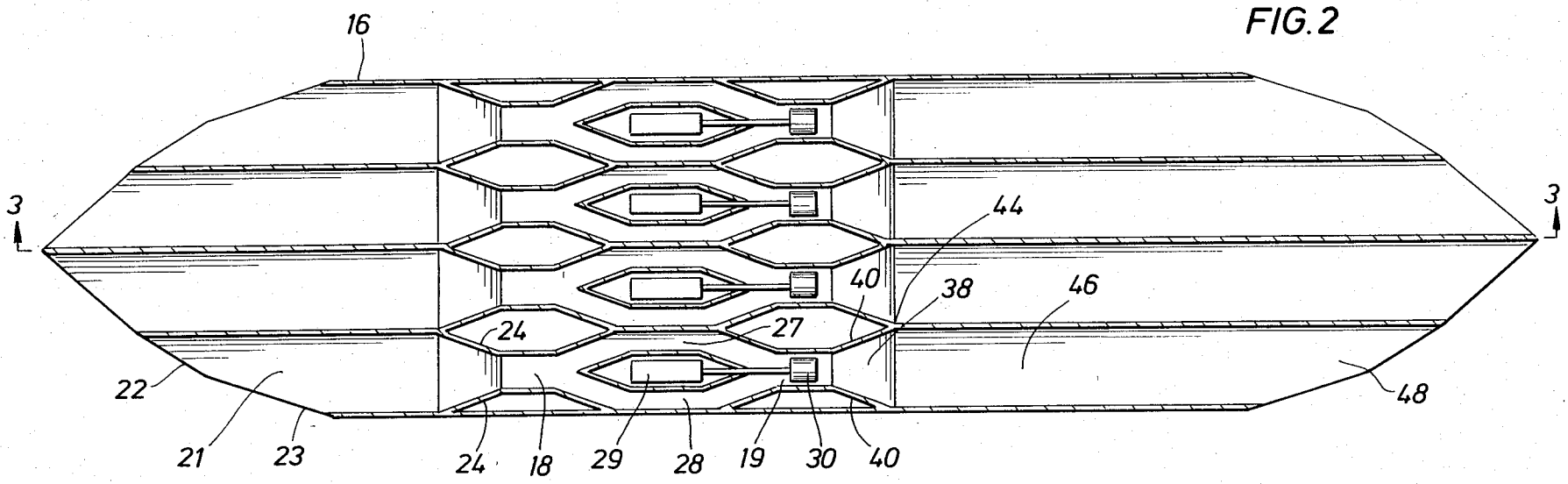
FIG. 2 is a top plan cross-sectional view of the vessel showing the thrust tubes of the invention.

Referring now to FIG. 2, it will be observed that the hull 16 is constructed in the fashion of a flat bottomed cargo barge with straight lines, unlike conventional vessel construction which employs curves to reduce the resistance of water with a streamlined bow. The hull 16 is identical at the bow and stern. It will be observed, that all conventional steering and stabilization gear such as the keel, bilge keel, skegs, rudders and bow and stern thrusters have been eliminated. The engine room found in conventional vessel design has been eliminated. Steering of the vessel 10 is accomplished by selective operation of the propellers 34 housed in the thrust tubes 20.

Figure 3:
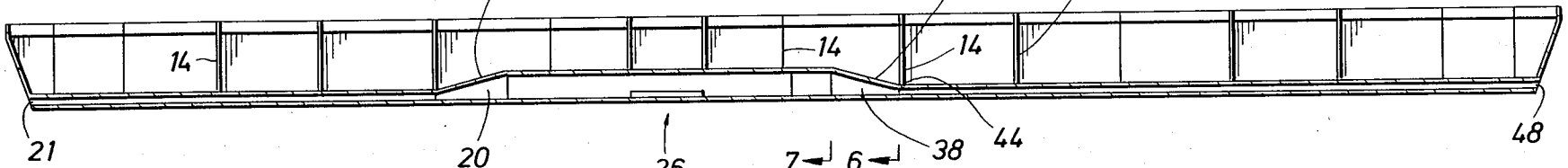
FIG. 3 is a cross-sectional view of the vessel of the invention taken along line 3—3 of FIG. 2.

Generally, most of the hull resistance occurs at the bow. Bow resistance of the vessel 10 is decreased by a factor dependent on the volume of water directed through the thrust tubes 20. The thrust tubes 20 extend the length of the vessel 10 as shown in FIGS. 2 and 3. The thrust tubes 20 are oriented parallel to each other and a plurality of tubes are incorporated in the hull 16 of the vessel to meet design criteria. The number and dimensions of the thrust tubes 20 varies according to scale factors for particular vessel designs. These scale factors include horse power, tonage, vessel dimensions, etc.

In FIG. 2, four thrust tubes 20 are shown extending the full length of the hull 16. The thrust tubes are identical in design with the exception that the innermost tubes are longer than the outermost tubes. One thrust tube will be described hereinafter, it being understood that all thrust tubes have substantially the same configuration. All thrust tubes open at the bow to ram water into the tubes at increased velocity to reduce the bow wave.

Figure 5:
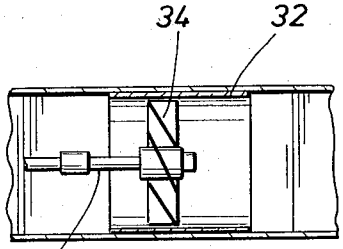
FIG. 5 is a cross-sectional view taken along line 5—5 of FIG. 3.
Figure 6:
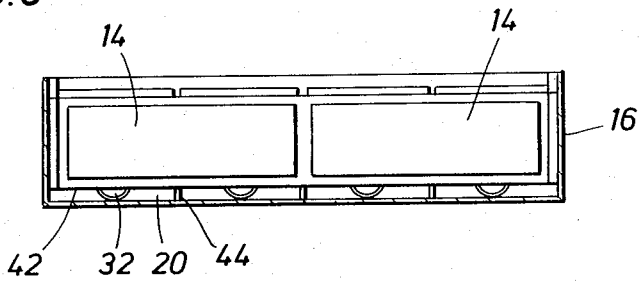
FIG. 6 is a cross-sectional view taken along line 6—6 of FIG. 3.

Beginning from the left of FIG. 2, this being the bow of the vessel 10, the thrust tube 20 is shown as incorporating an inlet opening 21. The inlet opening 21 is a substantially retangular shaped opening at the bow of the hull 16, a portion of the opening being defined by walls 22 and 23 of the hull 16. The thrust tubes 20 have a substantially retangular shape defined by wall members extending substantially the full length of the tubes as is best shown in the cross-sectional views of FIGS. 5 and 6.

The thrust tube 20 incorporates wall members 24 terminating at the entrance 18 of the venturi housing 26. The members 24 are vertically disposed walls of the thrust tube 20 and are converging inwardly just forward of the venturi housing entrance 18. As best shown in FIG. 3, the thrust tube 20 also includes an upwardly directed wall member 25 terminating at the venturi housing entrance. The members 24 and 25 form a transition zone for the fluid entering the venturi housing.

Figure 4:
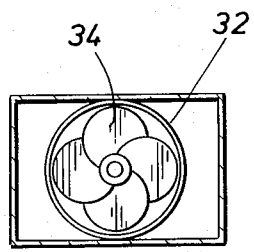
FIG. 4 is a cross-sectional view of the propeller and thrust housing of the invention.
Figure 7:
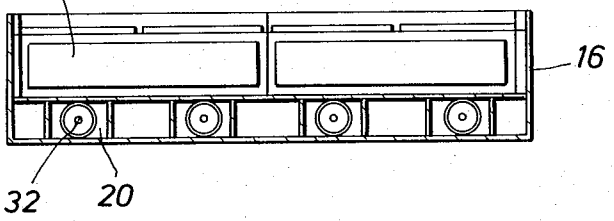
FIG. 7 is a cross-sectional view taken along line 7—7 of FIG. 3.

Within the venturi housing 26, fluid flow is split and directed though parallel conduits 27 and 28 which straddle an engine housing 29 and again merge into a single conduit at the venturi housing exit 19. A thrust unit 30 is located in the thrust tube 20 adjacent to and downstream of the venturi housing exit. The thrust unit 30 comprises a cylindrical shroud 32 (best shown in FIG. 4) concentrically located within the thrust tube 20. The shroud 32 houses a propeller 34 which is connected to the engine via a driveshaft 36. An exposed propeller loses approximately 30% of its efficiency to centrifical force by moving fluid radially to the outside of the propeller. The shroud 32 minimizes the loss of efficiency of the propeller 34 by substantially reducing the lateral flow away from the propeller 34 and thus obtaining as much as 93% efficiency from the propeller. While some of the fluid directed through the thrust tube 20 is permitted to flow through the annular clearance space around the outer circumferential wall of the shroud 32 substantially all of the water flowing through the thrust tube 20 is directed through the propeller 34 in the thrust unit 30. Downstream and immediately adjacent the thrust unit 30 the thrust tube 20 is provided with a transition zone 38. The transition zone 38 is defined at one end by outwardly directed walls 40; the wall portion 42 in FIG. 3 extends deeper, increasing the cross-sectional area. The walls 40 and 42 terminate at 44 which defines the end point of the transition zone 38. At this outlet, the velocity of the water flowing through the tube 20 is markedly reduced. Water velocity in this portion of the tube 20 decreases toward ambient flow. Thus, the pressure and velocity of the water in the area of the stern drops until it is substantially equal to the pressure and velocity of the water in the area of the bow. The thrust tube 20 is open at both ends however, pressure, velocity and flow rate differentials are created within the thrust tube 20 resulting in a net thrust force to the left, for the example described pertaining to FIG. 2 of the drawing.

To more clearly understand the thrust propulsion system of the present invention, water flow through the thrust tube 20 will be described. It is understood that the following example is for illustrative purposes only and not to be considered as limiting the scope of the invention in any respect. The engine of the vessel 10 is turned on so that water flows in the inlet 21 of the tube 20 at 10 gallons per minute. In the transition zone defined by the walls 24, the cross-sectional area of the tube 20 is reduced thus the velocity of the water flowing therethrough is increased to 20 gallons per minute at the venturi housing entrance 18. The velocity of the water drops slightly through the split in the venturi because the sum of the cross-sectional areas of the conduits 27 and 28 is slightly greater than the cross-sectional area at the entrance 18 of the venturi. The velocity of the fluid is increased again at the exit 19 of the venturi to approximately 20 gallons per minute as it approaches the thrust unit 30 and propeller 34. The velocity of the water is further increased by the action of the propeller 34 to approximately 30 gallons per minute. However, as the water exits the thrust unit 30 a rapid decrease in fluid velocity is encountered in the transition zone 38. This loss of velocity generates a thrust force against the propeller 34 which is transmitted to the structure of the vessel 10 for moving the vessel through the water. The fluid velocity in the exit portion of the thrust tube 20 decreases from approximately 10 gallons per minute at point 46 in the thrust tube 20 to ambient conditions at the outlet opening 48. By selecting the direction fluid flow through different thrust tubes 20, the vessel 10 can manuever 360° on a horizontal plane and rotate on a point axis. Furthermore, the vessel 10 can move fore and aft, side to side and in an arch without use of conventional steering gear such as external propellers, rudders, bow or stern thruster units.

The variations in velocity mentioned above coupled with changes in cross-sectional area create thrust; also, inlet vacuum pull reduces bow wave water displacement; propulsion is enhanced by all these factors; thrust propulsion is thereby accomplished.

The foregoing is directed to the preferred embodiment but the scope is determined by the claims which follow.

What is claimed is:

1. A vessel comprising:
(a) a deck;
(b) a hull;
(c) bulkhead means separating said hull and said deck providing structural strength for said vessel;
(d) at least two parallel thrust tubes incorporated in said hull of said vessel, said thrust tubes defining fluid passages extending longitudinally along said hull, each of said thrust tubes having substantially identical inlet and outlet openings and sharing a common wall therebetween defining a portion of said thrust tubes;
(e) a venturi housing forming a portion of each of said thrust tubes, said venturi housing including an entrance and an exit;
(f) wherein said thrust tubes include a first transition zone terminating at the entrance of said venturi housing, said transition zone being defined by wall members of said thrust tubes, said wall members including vertically disposed converging side walls having upwardly inclined top edges supporting an upwardly directed top wall, said side walls extending upwardly from a horizontally disposed bottom wall; and
(g) propulsion means for moving said vessel through a fluid medium.

2. The apparatus of claim 1 wherein said venturi housing comprises two conduits separating at the entrance of said venturi housing and joining at the exit thereof.

3. The apparatus of claim 1 wherein said propulsion means includes a motor operatively connected to a propeller located in each of said thrust tubes.

4. The apparatus of claim 2 wherein said propeller is housed within a cylindrical thrust housing concentrically positioned within each of said thrust tubes.

5. The apparatus of claim 1 including a second transition zone formed by wall portions of said thrust tubes and located adjacent the exit of said venturi housing.

* * * * *